US011339635B2

(12) United States Patent
Ramsey

(10) Patent No.: US 11,339,635 B2
(45) Date of Patent: May 24, 2022

(54) ARTIFICIAL LIFT SYSTEM WITH ENCLOSED ROD ROTATOR

(71) Applicant: WEATHERFORD TECHNOLOGY HOLDINGS, LLC, Houston, TX (US)

(72) Inventor: Michael C. Ramsey, Round Rock, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 670 days.

(21) Appl. No.: 15/698,571

(22) Filed: Sep. 7, 2017

(65) Prior Publication Data

US 2019/0071956 A1 Mar. 7, 2019

(51) Int. Cl.

| | |
|---|---|
| ***E21B 43/12*** | (2006.01) |
| ***F04B 47/02*** | (2006.01) |
| ***F04B 9/10*** | (2006.01) |
| ***F15B 15/06*** | (2006.01) |
| *E21B 34/06* | (2006.01) |

(52) U.S. Cl.

CPC ..... *E21B 43/129* (2013.01); *F04B 9/10* (2013.01); *F04B 47/02* (2013.01); *F15B 15/068* (2013.01); *E21B 34/06* (2013.01)

(58) Field of Classification Search

CPC ..... E21B 1/00

See application file for complete search history.

(56) References Cited

U.S. PATENT DOCUMENTS

| | | | | |
|---|---|---|---|---|
| 2,932,204 | A * | 4/1960 | Elves | E21B 1/02 74/21 |
| 3,030,935 | A * | 4/1962 | Hanes | E21B 43/12 92/2 |
| 5,351,583 | A * | 10/1994 | Szymber | B25B 13/462 192/44 |
| 6,155,792 | A | 12/2000 | Hartley et al. | |
| 7,857,043 | B2 | 12/2010 | Ali-Zada et al. | |
| 9,140,113 | B2 | 9/2015 | Hurst et al. | |

(Continued)

OTHER PUBLICATIONS

Office Action dated Dec. 12, 2017 for U.S. Appl. No. 14/964,913, 21 pages.

(Continued)

*Primary Examiner* — William D Hutton, Jr.
*Assistant Examiner* — Avi T Skaist
(74) *Attorney, Agent, or Firm* — Smith IP Services, P.C.

(57) ABSTRACT

An artificial lift system can include an actuator operable to reciprocate a rod string in the well, the actuator including a piston reciprocably disposed in a cylinder, and a piston rod connected to the piston, and a rod rotator that continuously rotates the piston rod relative to the cylinder as the piston displaces in a longitudinal direction relative to the cylinder. A method of rotating a rod string can include connecting the rod string to a piston rod of an actuator, longitudinally reciprocating the piston rod relative to a cylinder of the actuator and a mandrel of a rod rotator, and rotating the piston rod relative to the mandrel in response to the reciprocating, the mandrel being disposed at least partially within the piston rod during the rotating. A rod rotator can include a mandrel having a helical external profile configured to attach to a cylinder of a hydraulic actuator, an internal profile complementarily shaped relative to the external profile, and a one-way clutch.

11 Claims, 6 Drawing Sheets

(56) References Cited

U.S. PATENT DOCUMENTS

| | | | | |
|---|---|---|---|---|
| 2004/0140087 | A1 | 7/2004 | Ferguson et al. | |
| 2007/0159161 | A1 | 7/2007 | Neill | |
| 2010/0212882 | A1* | 8/2010 | Guven | E21B 34/10 166/65.1 |
| 2016/0010640 | A1* | 1/2016 | Tetzlaff | F04B 47/06 417/53 |
| 2017/0145799 | A1 | 5/2017 | Thomas et al. | |
| 2017/0167236 | A1 | 6/2017 | Trapani et al. | |

OTHER PUBLICATIONS

Weatherford; "Intelligent Rod Rotator", company article 10866.00, dated 2013, 8 pages.
Helac, "Hydraulic Rotary Actuators", web article via www.helac.com/products/rotary-actuators, dated Aug. 8, 2017, 2 pages.
JLG; "Service and Maintenance Manual—Model E300A, E300AJ, E300AJP", dated Jan. 23, 2009, 4 pages.
Office Action dated Jun. 13, 2019 for U.S. Appl. No. 14/964,913, 15 pages.
Office Action dated May 29, 2019 for U.S. Appl. No. 14/947,919, 9 pages.
Office Action dated Apr. 19, 2018 for U.S. Appl. No. 14/947,919, 19 pages.
Office Action dated Oct. 18, 2018 for U.S. Appl. No. 14/947,919, 14 pages.
Examiner's Answer dated Jun. 10, 2020 for U.S. Appl. No. 14/947,919, 13 pages.

* cited by examiner

ARTIFICIAL LIFT SYSTEM WITH ENCLOSED ROD ROTATOR

BACKGROUND

This disclosure relates generally to operations and equipment utilized in conjunction with a subterranean well and, in an example described below, more particularly provides an artificial lift system, a rod rotator and associated methods for use with a well.

Reservoir fluids can sometimes flow to the earth's surface when a well has been completed. However, with some wells, reservoir pressure may be insufficient (at the time of well completion or thereafter) to lift the fluids (in particular, liquids) to the surface. In those circumstances, technology known as "artificial lift" can be employed to bring the fluids to the surface (or other desired location, such as a subsea production facility or pipeline, etc.).

Various types of artificial lift technology are known to those skilled in the art. In one type of artificial lift, a downhole pump is operated by reciprocating a string of "sucker" rods deployed in a well. An apparatus (such as, a walking beam-type pump jack or a hydraulic actuator) located at the surface can be used to reciprocate the rod string.

Therefore, it will be readily appreciated that improvements are continually needed in the arts of constructing and operating artificial lift systems. Such improvements may be useful for lifting oil, water, gas condensate or other liquids from wells, may be useful with various types of wells (such as, gas production wells, oil production wells, water or steam flooded oil wells, geothermal wells, etc.), and may be useful for any other application where reciprocating motion is desired.

DETAILED DESCRIPTION

Figure 1:
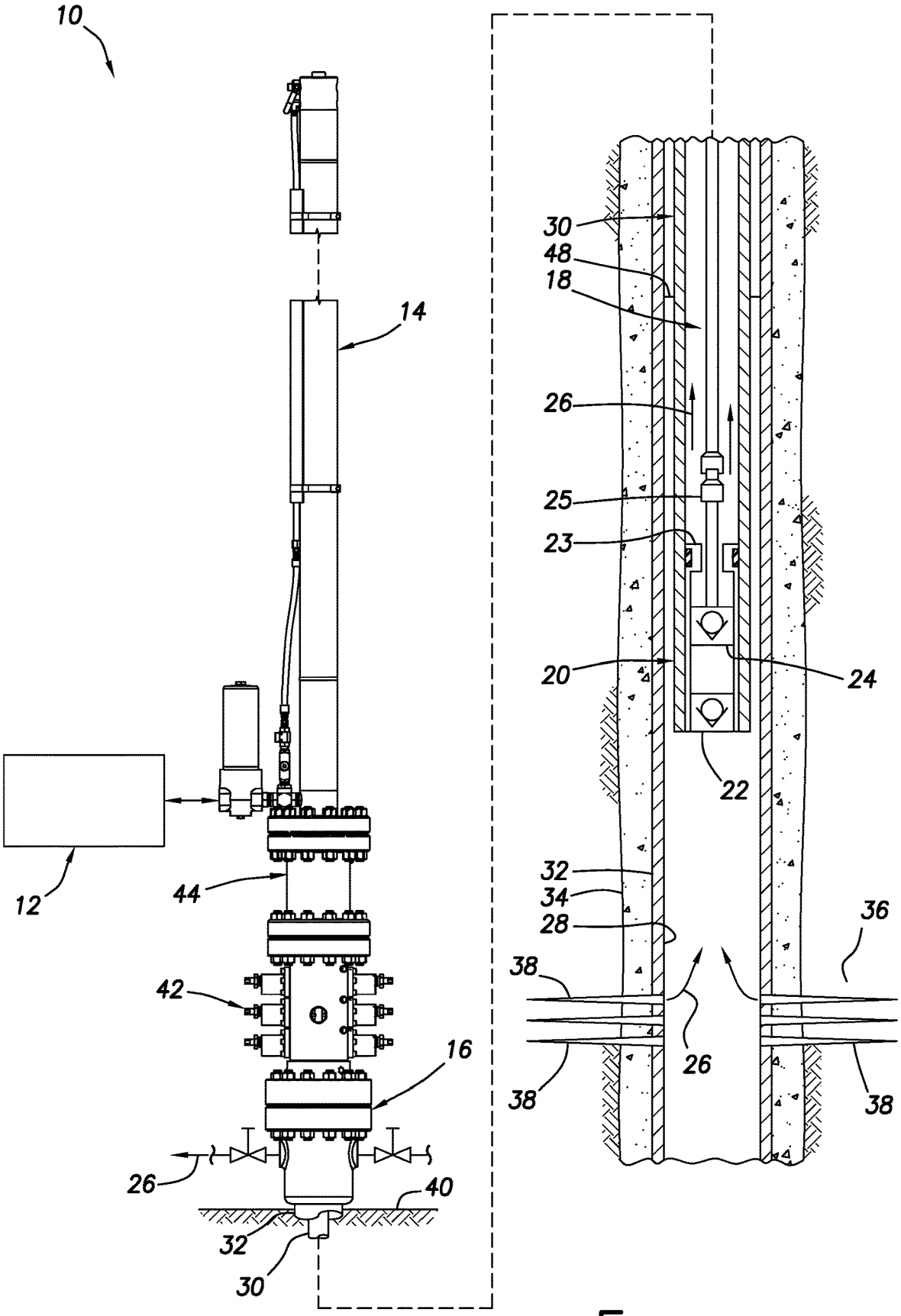
FIG. 1 is a representative partially cross-sectional view of an example of an artificial lift system and associated method which can embody principles of this disclosure.

Representatively illustrated in FIG. 1 is an artificial lift system 10 and associated method for use with a subterranean well, which system and method can embody principles of this disclosure. However, it should be clearly understood that the artificial lift system 10 and method are merely one example of an application of the principles of this disclosure in practice, and a wide variety of other examples are possible. Therefore, the scope of this disclosure is not limited at all to the details of the system 10 and method as described herein or depicted in the drawings.

In the FIG. 1 example, a hydraulic pressure source 12 is used to apply hydraulic pressure to, and exchange hydraulic fluid with, a hydraulic actuator 14 mounted on a wellhead 16. In response, the hydraulic actuator 14 reciprocates a rod string 18 extending into the well, thereby operating a downhole pump 20.

The rod string 18 is made up of individual sucker rods connected to each other. The rod string 18 communicates reciprocating motion of the hydraulic actuator 14 to the downhole pump 20.

The downhole pump 20 is depicted in FIG. 1 as being of the type having a stationary or "standing" valve 22 and a reciprocating or "traveling" valve 24. The traveling valve 24 is connected to, and reciprocates with, the rod string 18, so that fluid 26 is pumped from a wellbore 28 into a production tubing string 30. However, it should be clearly understood that the downhole pump 20 is merely one example of a wide variety of different types of pumps that may be used with the artificial lift system 10 and method of FIG. 1, and so the scope of this disclosure is not limited to any of the details of the downhole pump described herein or depicted in the drawings.

The wellbore 28 is depicted in FIG. 1 as being generally vertical, and as being lined with casing 32 and cement 34. In other examples, a section of the wellbore 28 in which the pump 20 is disposed may be generally horizontal or otherwise inclined at any angle relative to vertical, and the wellbore section may not be cased or may not be cemented. Thus, the scope of this disclosure is not limited to use of the artificial lift system 10 and method with any particular wellbore configuration.

In the FIG. 1 example, the fluid 26 originates from an earth formation 36 penetrated by the wellbore 28. The fluid 26 flows into the wellbore 28 via perforations 38 extending through the casing 32 and cement 34. The fluid 26 can be a liquid, such as oil, gas condensate, water, etc. However, the scope of this disclosure is not limited to use of the artificial lift system 10 and method with any particular type of fluid, or to any particular origin of the fluid.

As depicted in FIG. 1, the casing 32 and the production tubing string 30 extend upward to the wellhead 16 at or near the earth's surface 40 (such as, at a land-based wellsite, a subsea production facility, a floating rig, etc.). The production tubing string 30 can be hung off in the wellhead 16, for example, using a tubing hanger (not shown). Although only a single string of the casing 32 is illustrated in FIG. 1 for clarity, in practice multiple casing strings and optionally one or more liner (a liner string being a pipe that extends from a selected depth in the wellbore 28 to a shallower depth, typically sealingly "hung off" inside another pipe or casing) strings may be installed in the well.

In the FIG. 1 example, a rod blowout preventer stack 42 and an annular seal housing 44 are connected between the hydraulic actuator 14 and the wellhead 16. The rod blowout preventer stack 42 includes various types of blowout preventers (BOP's) configured for use with the rod string 18. For example, one blowout preventer can prevent flow through the blowout preventer stack 42 when the rod string 18 is not present therein, and another blowout preventer can prevent flow through the blowout preventer stack 42 when the rod string 18 is present therein. However, the scope of this disclosure is not limited to use of any particular type or configuration of blowout preventer stack with the artificial lift system 10 and method of FIG. 1.

The annular seal housing 44 includes an annular seal (not shown) about a piston rod of the hydraulic actuator 14. The piston rod (described more fully below) connects to the rod string 18 below the annular seal, although in other examples a connection between the piston rod and the rod string 18 may be otherwise positioned. A conventional stuffing box may be used for the annular seal housing 44 in some examples.

The hydraulic pressure source 12 may be connected directly to the hydraulic actuator 14, or it may be positioned remotely from the hydraulic actuator 14 and connected with, for example, suitable hydraulic hoses or pipes. The hydraulic pressure source 12 controls pressure in the hydraulic actuator 14, so that the rod string 18 is displaced alternately to its upper and lower stroke extents.

Figure 2:
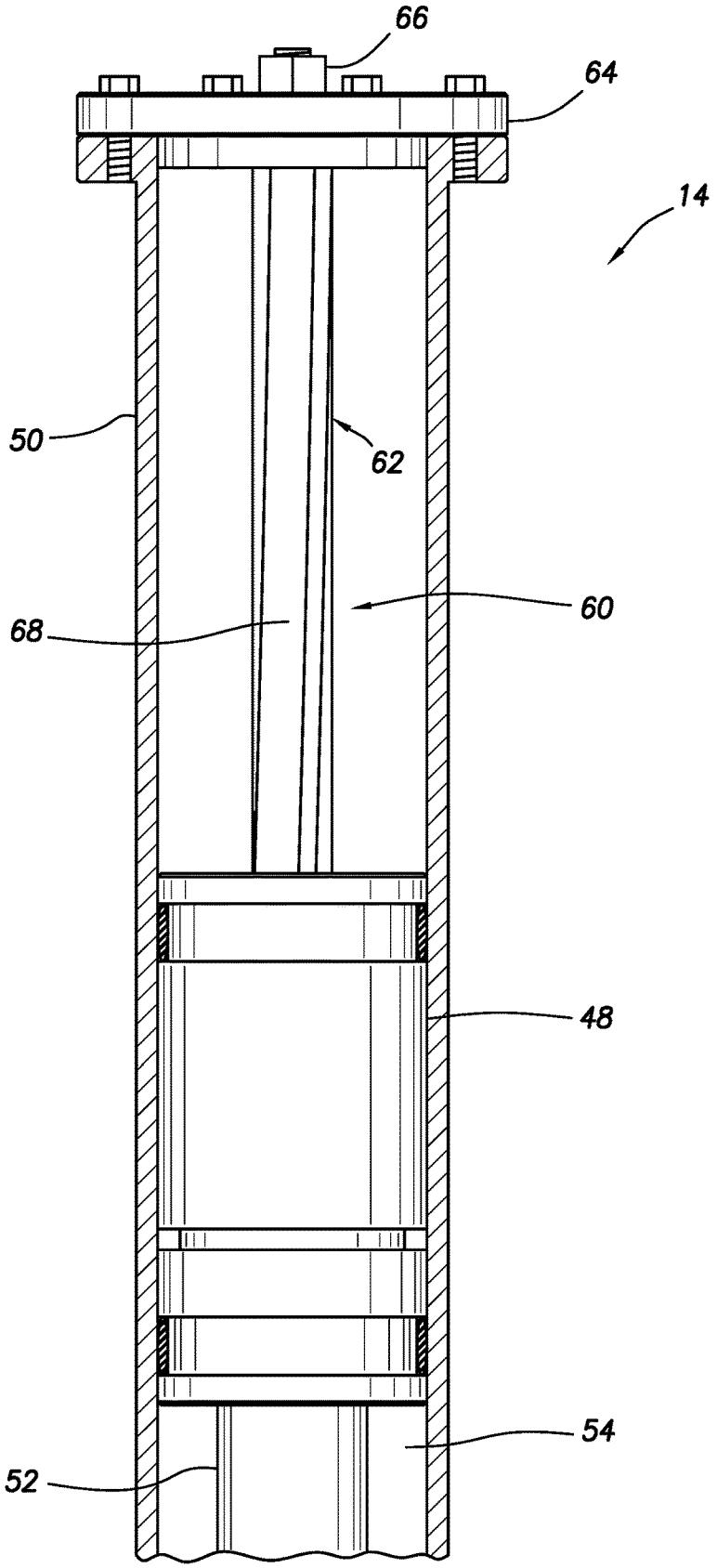
FIG. 2 is a representative partially cross-sectional view of an example of a hydraulic actuator of the FIG. 1 artificial lift system.

Referring additionally now to FIG. 2, a partially cross-sectional view of an example of the hydraulic actuator 14 is representatively illustrated. The FIG. 2 hydraulic actuator 14 may be used with the artificial lift system 10 and method of FIG. 1, or it may be used with other artificial lift systems and methods.

In the FIG. 2 example, a piston 48 is slidingly and sealingly received within a cylinder 50. A piston rod 52 is connected at an upper end to the piston 48. At a lower end thereof, the piston rod 52 is connected to the rod string 18 in the FIG. 1 system 10.

The pressure source 12 applies increased pressure to an annular chamber 54 formed radially between the cylinder 50 and the piston rod 52, in order to displace the piston 48 longitudinally upward (as viewed in FIG. 2). The pressure source 12 reduces the pressure in the chamber 54, in order to allow the piston 48 to displace longitudinally downward. Thus, the piston 48, the piston rod 52 and the attached rod string 18 reciprocate upwardly and downwardly together, thereby operating the downhole pump 20.

A rod rotator 60 is used with the hydraulic actuator 14. The rod rotator 60, in this example, causes the piston 48, the piston rod 52 and the attached rod string 18 to rotate periodically, and can thereby enhance longevity of the rod string by evening out wear of the rod string in the well.

The rod rotator 60 of FIG. 2 is completely "passive," in that it operates automatically, without human intervention, and requires no additional external power source for its operation. Moving and interacting components of the rod rotator 60 are few (thereby enhancing reliability and serviceability), and are contained within the cylinder 50 (so that they are protected from the environment and damage).

As depicted in FIG. 2, the rod rotator 60 includes a longitudinally elongated mandrel 62, which is suspended within the cylinder 50 by a cylinder connector 64. In this example, the cylinder connector 64 is connected to the cylinder 50 with a flanged connection, but other connections (such as, a threaded or clamped connection) may be used in other examples. An attachment 66 (such as, a bolt, screw, stud, nut, etc.) is used to secure the mandrel 62 to the cylinder connector 64.

Note that the mandrel 62 has an external helical profile 68 formed thereon. The helical profile 68 is in the shape of a helical external spline formed on the mandrel 62 (see FIGS. 5 & 6), but other profiles (such as, variously shaped grooves, projections, etc.) may be used in other examples. The scope of this disclosure is not limited to use of any particular shape or configuration of the helical profile 68.

Note, also, that the mandrel 62 is received in the piston 48 and piston rod 52. The piston 48 and piston rod 52 are suitably configured for insertion of the mandrel 62 therein, as described more fully below.

Figure 3:
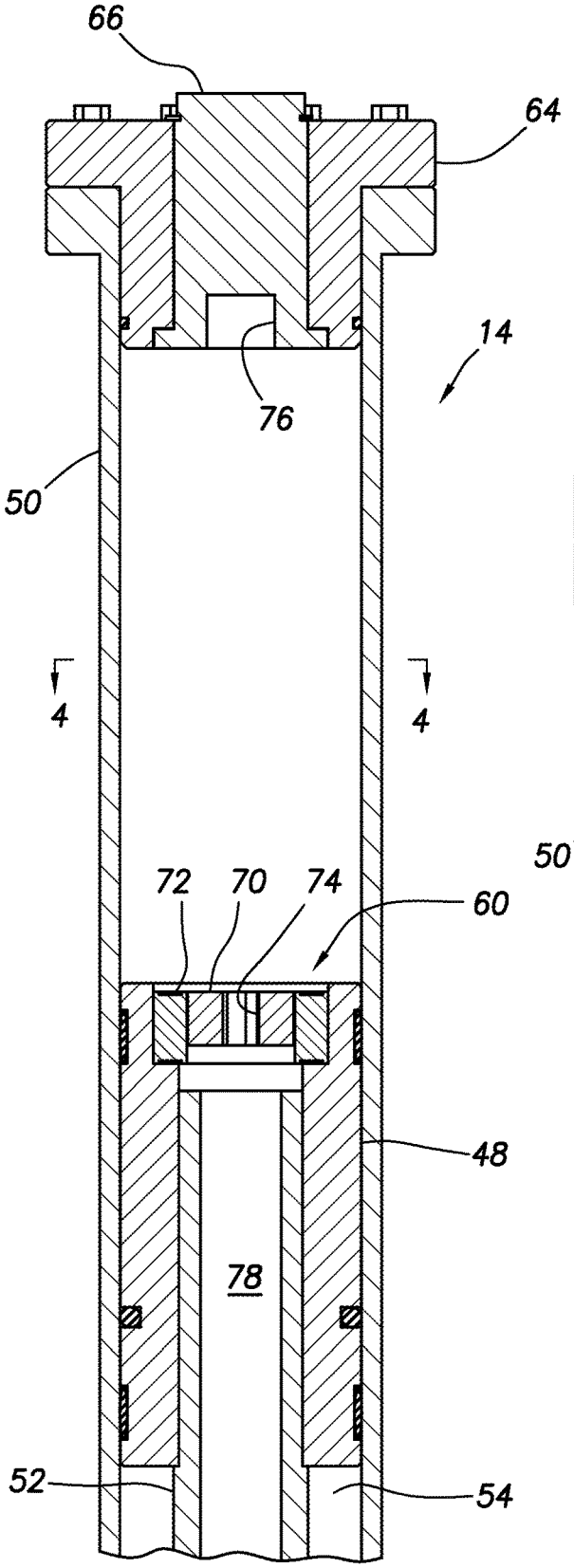
FIG. 3 is a representative cross-sectional view of the hydraulic actuator.

Referring additionally now to FIGS. 3, A & 4, longitudinal and lateral cross-sectional views of examples of the actuator 14 and rod rotator 60 are representatively illustrated. The mandrel 62 is not shown in FIGS. 3 & 4 for clarity in depicting other components of the rod rotator 60.

Figure 4:
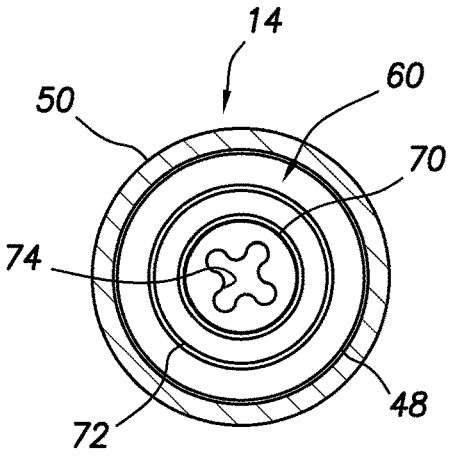
FIG. 4 is a representative cross-sectional view of the hydraulic actuator, taken along line 4-4 of FIG. 3.

In the FIGS. 3 & 4 example, the rod rotator 60 includes an insert 70 and a one-way clutch 72. The insert 70 and one-way clutch 72 are depicted as being positioned within the piston 48, but these components could be otherwise positioned in other examples (such as, in or otherwise attached to the piston rod 52, connected above the piston 48, etc.).

The insert 70 has an internal profile 74 formed therein which is complementarily shaped relative to the external profile 68 on the mandrel 62. The insert 70 cooperatively and slidingly engages the mandrel 62 as the piston 48 and piston rod 52 reciprocate in the cylinder 50. Note that it is not necessary for the internal profile 74 to be helical, but the internal profile 74 and the external profile 68 are preferably cooperatively shaped, so that the insert 70 is caused by the engagement of the profiles 68, 74 to rotate as it displaces longitudinally relative to the mandrel 62.

In this example, the engagement between the insert profile 74 and the mandrel profile 68 will cause the insert 70 to rotate in one rotational direction (clockwise, or in a right-hand direction, as viewed from above) relative to the mandrel 62, as the insert 70, piston 48 and piston rod 52 displace downward in the cylinder 50. The insert 70 will rotate in an opposite rotational direction (counter-clockwise, or in a left-hand direction, as viewed from above) relative to the mandrel 62, as the insert 70, piston 48 and piston rod 52 displace upward in the cylinder 50. In other examples, the insert 70 could rotate otherwise relative to the mandrel 62.

It is advantageous in this example for the insert 70, along with the piston 48, the piston rod 52 and the attached rod string 18 to rotate in the clockwise or right hand direction as the rod string descends in the wellbore 28. There are no buckling loads induced in the mandrel 62 due to downward displacement of the piston 48 and piston rod 52, and friction loads against the casing 32 are reduced when the rod string 18 descends in the wellbore 28, as compared to when the rod string ascends. However, the scope of this disclosure is not limited to any particular direction of piston 48 and rod 52 longitudinal displacement when these components rotate in any particular rotational direction.

The one-way clutch 72 permits the insert 70 to rotate in the counter-clockwise or left hand direction as the piston 48 and piston rod 52 ascend in the cylinder 50. The piston 48 and piston rod 52 do not rotate when they ascend in the cylinder 50, due to friction between the piston (or seals thereon) and the cylinder. However, in some examples, an anti-rotation device or friction enhancer may be used to prevent rotation of the piston 48 and piston rod 52 in the counter-clockwise direction relative to the cylinder 50.

Figure 3A:
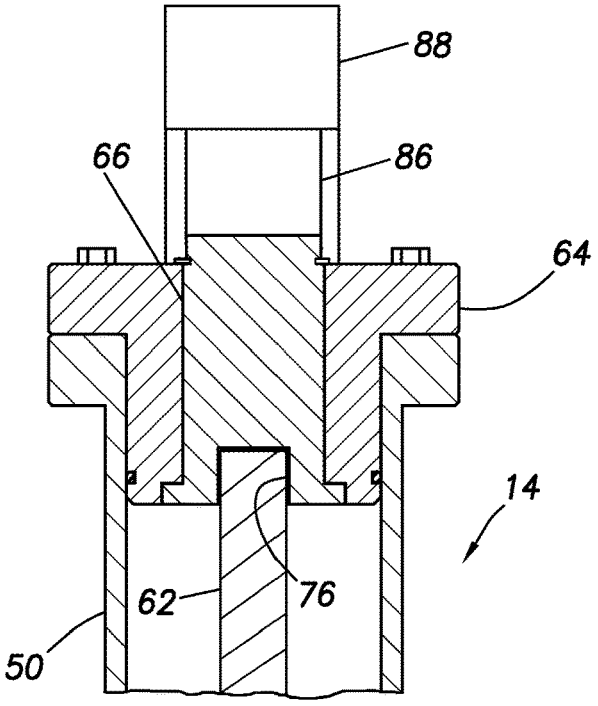
FIG. 3A is a representative cross-sectional view of another example of the hydraulic actuator.

Note that the cylinder connector 64 and mandrel attachment 66 are differently configured in the FIGS. 3 & 3A examples, as compared to the FIG. 2 example. The attachment 66 in the FIGS. 3 & 3A examples includes a recess or receptacle 76 therein for receiving an upper end of the mandrel 62. The mandrel 62 may be welded, bonded or otherwise secured in the receptacle 76.

When the mandrel 62 is suspended in the cylinder 50 by the cylinder connector 64 and attachment 66, the mandrel is received in an internal bore 78 extending longitudinally in the piston 48 and rod 52. Thus, the mandrel 62 is "telescoped" within the piston 48 and rod 52 during operation of the actuator 14.

In the FIG. 3A example, a rotary actuator 88 is used to apply torque to the mandrel 62 via the attachment 66, in order to assist in rotation of the piston 48 and attached rod string 18. In other examples, the rotary actuator 88 could apply the torque directly to the mandrel 62. The rotary actuator 88 may in some examples comprise an electrical, pneumatic or hydraulic motor, or another device capable of applying torque to the mandrel 62.

The torque may be applied continuously, periodically, as the piston 48 ascends in the cylinder 50, or as the piston descends in the cylinder. Operation of the rotary actuator 88 may be controlled by the control system 12.

A sensor 86 may be used to measure torque in the mandrel 62. Torque in the mandrel 62 may be due to the rotation imparted by the profile 68 to the piston 48 and attached rod string 18 via the insert 70 and one-way clutch 72. Torque in the mandrel 62 may also be due to operation of the rotary actuator 88.

The torque in the mandrel 62 can vary based on a variety of different factors. A condition of the rod string 18 as it relates to movement in the tubing string 30 (including, for example, build-up of scale in the tubing string, wear on rod guides, etc.) can affect the torque needed to rotate the rod string within the tubing string.

The sensor 86 can be connected to the control system 12 for recording and evaluation of the torque measurements. The condition of the rod string 18 and the tubing string 30, and the efficiency of the pumping operation, can be determined based on the torque measurements.

Figure 5:
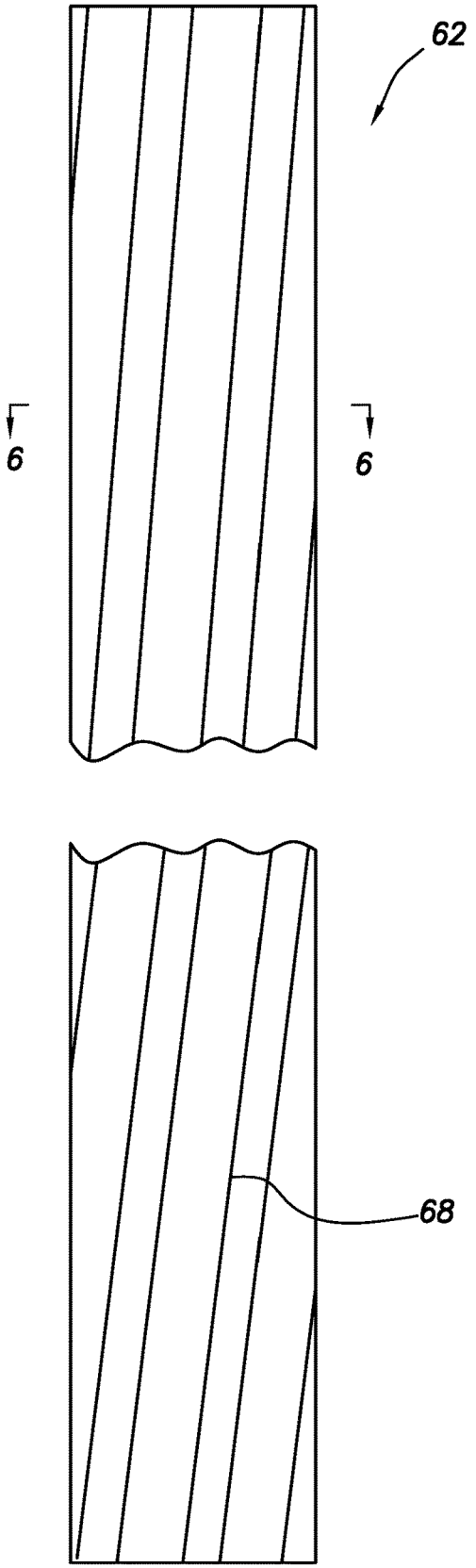
FIG. 5 is a representative side view of a mandrel of a rod rotator that may be used with the hydraulic actuator.
Figure 6:
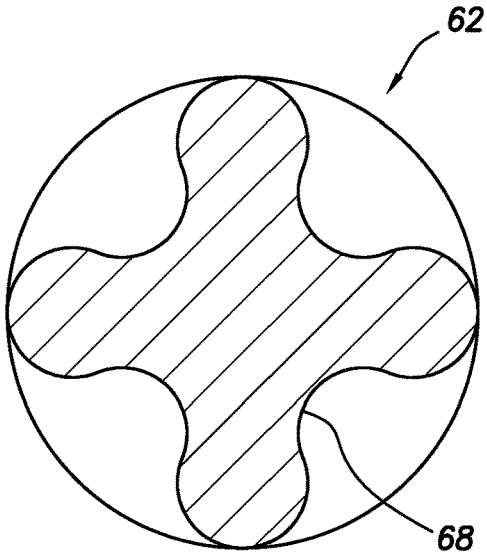
FIG. 6 is a representative cross-sectional view of the mandrel, taken along line 6-6 of FIG. 5.

Referring additionally now to FIGS. 5 & 6, side and lateral cross-sectional views of an example of the mandrel 62 are representatively illustrated. In these views, it may be seen that the external helical profile 68 is in the shape of a four-lobed helical spline extending externally along the mandrel 62.

Other shapes for the profile 68 may be used, in keeping with the scope of this disclosure. In this example, the profile 68 extends an entire length of the mandrel 62, but in other examples the external profile may be formed on only a portion of the mandrel.

Figure 7:
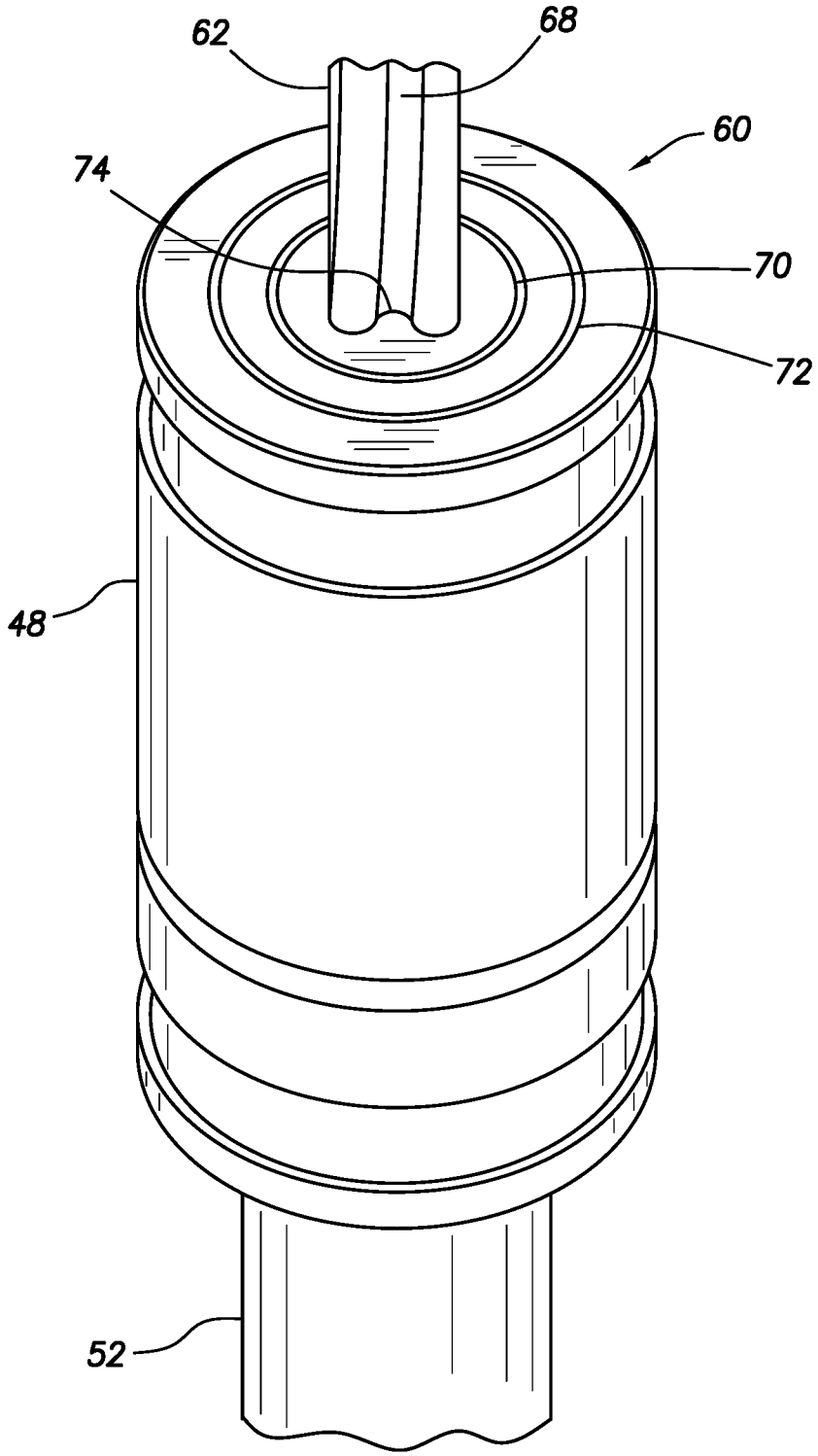
FIG. 7 is a representative perspective view of the rod rotator with a piston and piston rod of the hydraulic actuator.

Referring additionally now to FIG. 7, a perspective view of the mandrel 62 slidingly engaged with the insert 70 is representatively illustrated. As mentioned above, the mandrel 62 is received in the bore 78 (see FIG. 3) in this configuration.

The one-way clutch 72 prevents the insert 70 from rotating in the clockwise or right-hand direction relative to the piston 48 and rod 52 as the piston and rod displace downward in the cylinder 50. Thus, the piston 48 and rod 52 are constrained to continuously rotate with the insert 70 in the clockwise or right-hand direction as the piston and rod descend. The rod string 18 also rotates with the insert 70, piston 48 and rod 52.

The one-way clutch 72 permits the insert 70 to rotate in the counter-clockwise or left-hand direction relative to the piston 48 and piston rod 52 as the piston and rod displace upward in the cylinder 50. Thus, the piston 48, piston rod 52 and rod string 18 do not rotate with the insert 70 as the piston and piston rod ascend.

As a result, right-hand or clockwise rotation is imparted to the rod string 18 continuously as the piston 48 and piston rod 52 displace downward, and the rod rotator 60 does not impart any rotation to the rod string as the piston and piston rod displace upward. In other examples, the rod string 18 could be rotated as the piston 48 and rod string 52 displace upward, or the rod string could be rotated as the piston and rod string displace in both longitudinal directions.

Figure 8:
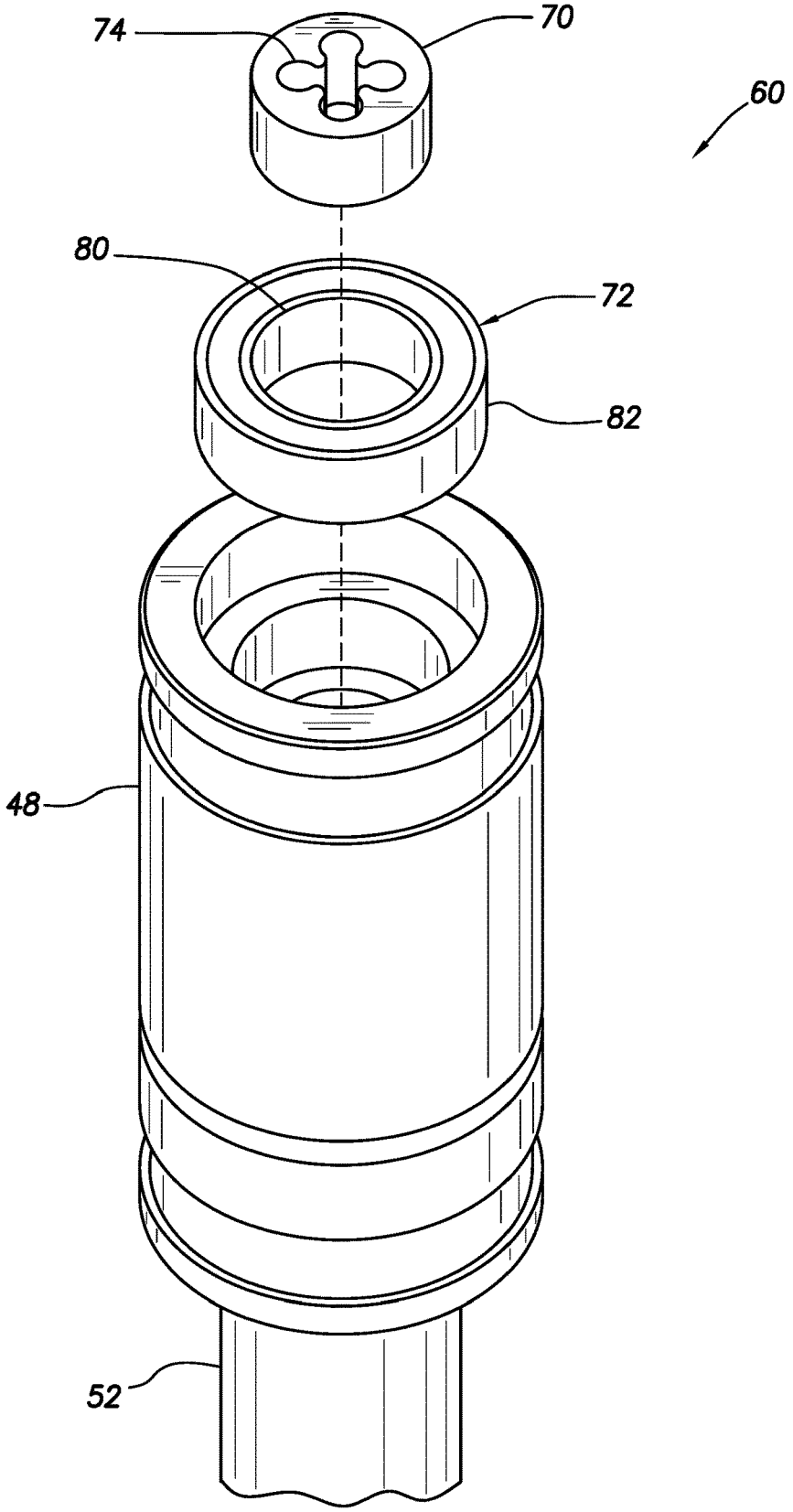
FIG. 8 is representative exploded perspective view of an insert and one-way clutch of the rod rotator with the piston and piston rod of the hydraulic actuator.

Referring additionally now to FIG. 8, an exploded view of the FIG. 7 rod rotator 60 is representatively illustrated with the piston 48 and piston rod 52, but without the mandrel 62. In this view, it may be seen that the one-way clutch 72 includes an inner component 80 (such as an inner race) and an outer component 82 (such as an outer race).

The inner component 80 is secured to the insert 70 (such as, by welding, bonding, press-fitting, etc.), so that the insert and the inner component displace rotationally and longitudinally together. In some examples, the insert 70 and the inner component 80 could be integrally formed (e.g., with the profile 74 formed in the inner component).

The outer component 82 is secured to the piston 48 (such as, by welding, bonding, press-fitting, etc.), so that the outer component, the piston, the piston rod 52 and the rod string 18 displace rotationally and longitudinally together. In some examples, the outer component 82 could be secured directly to the piston rod 52, or could be integrally formed with the piston 48 or piston rod 52.

A suitable device that may be used for the one-way clutch 72 is known to those skilled in the art as a sprag bearing or sprag clutch. Such devices have "sprags" positioned between inner and outer races. The sprags permit relative rotation between the races in one direction, but prevent relative rotation between the races in an opposite direction. However, other types of one-way clutches (such as, ratchets, etc.) may be used, in keeping with the scope of this disclosure.

Note that, in operation, the one-way clutch 72, insert 70 and mandrel 62 are positioned within the cylinder 50. This prevents dirt and debris from fouling the rod rotator 60, and protects it from damage due to inadvertent impacts, mishandling, etc.

It may now be fully appreciated that the above disclosure provides significant advancements to the art of constructing and operating artificial lift systems. In one example described above, a hydraulic actuator 14 can be used with a rod rotator 60 that incrementally rotates a rod string 18 as a piston 48 reciprocates in a cylinder 50 of the actuator. The rod rotator 60 rotates the rod string 18 continuously as the piston 48 displaces in at least one longitudinal direction. Active components of the rod rotator 60 are disposed in the cylinder 50.

The above disclosure provides to the art an artificial lift system 10 for use with a subterranean well. In one example, the system 10 comprises an actuator 14 operable to reciprocate a rod string 18 in the well, the actuator 14 including a piston 48 reciprocably disposed in a cylinder 50, and a piston rod 52 connected to the piston 48. A rod rotator 60 continuously rotates the piston rod 52 relative to the cylinder 50 as the piston 48 displaces in a first longitudinal direction relative to the cylinder 50.

The first longitudinal direction comprises a downward direction. In other examples, the first longitudinal direction could be an upward or other direction.

The rod rotator 60 may produce no rotation of the piston rod 52 relative to the cylinder 50 as the piston 48 displaces in a second longitudinal direction (e.g., upward) opposite to the first longitudinal direction.

The rod rotator 60 may include a mandrel 62 having a helical first profile 68. The first profile 68 may comprise a helical external spline formed on the mandrel 62. The mandrel 62 may be disposed within the cylinder 50.

The mandrel 62 may be slidingly engaged with a second profile 74 that reciprocates with the piston 48 and piston rod 52. The second profile 74 may be prevented from rotating in a first rotational direction relative to the piston 48 and/or piston rod 52, and the second profile 74 may be permitted to rotate in an opposite second rotational direction relative to the piston 48 and/or piston rod 52.

A one-way clutch 72 of the rod rotator 60 may prevent rotation of the second profile 74 in a first rotational direction relative to the piston 48 and/or piston rod 52. The one-way clutch 72 may permit rotation of the second profile 74 in an opposite second rotational direction relative to the piston 48 and/or piston rod 52. The second profile 74 may be disposed within the cylinder 50.

The above disclosure also provides to the art a method of rotating a rod string 18 in a subterranean well. In one example, the method can include: connecting the rod string 18 to a piston rod 52 of an actuator 14; longitudinally reciprocating the piston rod 52 relative to a cylinder 50 of the actuator 14 and a mandrel 62 of a rod rotator 60; and rotating the piston rod 52 relative to the mandrel 62 in response to the reciprocating, the mandrel 62 being disposed at least partially within the piston rod 52 during the rotating.

The reciprocating step can include slidingly engaging an internal profile 74 with the mandrel 62, the internal profile 74 reciprocating with the piston rod 52. The internal profile 74 may slidingly engage a helical external profile 68 on the mandrel 62.

The rotating step can include preventing rotation of the internal profile 74 relative to the piston rod 52 in a first rotational direction in response to displacement of the rod string 18 in a first longitudinal direction, and rotating the internal profile 74 in a second rotational direction opposite to the first rotational direction relative to the rod string 18 in response to displacement of the rod string 18 in a second longitudinal direction opposite to the first longitudinal direction.

The rotating step may include rotating the piston rod 52 in a first rotational direction relative to the mandrel 62 in response to displacement of the rod string 18 in a first longitudinal direction, and preventing rotation of the piston rod 52 in a second rotational direction opposite to the first rotational direction relative to the mandrel 62. The rotation preventing step may include engaging a one-way clutch 72 that prevents rotation of the piston rod 52 relative to the mandrel 62 in the second rotational direction.

The method may include positioning the mandrel 62 within the cylinder 50. The method may include positioning the mandrel 62 at least partially within a piston 48 that reciprocates with the piston rod 52.

The rotating step may include rotating the piston rod 52 continuously as the piston rod 52 displaces relative to the mandrel 62. The piston rod 52 may rotate continuously as the piston rod 52 displaces in the first longitudinal direction relative to the mandrel 62.

A rod rotator 60 for rotating a rod string 18 in a subterranean well is also described above. In one example, the rod rotator 60 can include an elongated mandrel 62 having a helical external profile 68, the mandrel 62 being configured to attach to a cylinder 50 of a hydraulic actuator; an internal profile 74 complementarily shaped relative to the external profile 68; and a one-way clutch 72 including first and second components 80, 82. The first component 80 is rotatable with the internal profile 74, and the second component 82 is configured for attachment to a piston 48 and/or a piston rod 52 of the hydraulic actuator 14. The one-way clutch 72 prevents the first component 80 from rotating in a first rotational direction relative to the second component 82, but permits rotation of the first component 80 relative to the second component 82 in a second rotational direction opposite to the first rotational direction.

The internal profile 74 may rotate relative to the mandrel 62 in the first rotational direction in response to displacement of the internal profile 74 relative to the mandrel 62 in a first longitudinal direction. The one-way clutch 72 may permit relative rotation between the internal profile 74 and the mandrel in a second rotational direction in response to displacement of the internal profile 74 relative to the mandrel 62 in a second longitudinal direction opposite to the first longitudinal direction.

The rod rotator 60 may include a cylinder connector 64 configured to suspend the mandrel 62 within the cylinder 50.

The helical external profile 68 may comprise a helical spline formed on the mandrel 62.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. An artificial lift system for use with a subterranean well, the system comprising:

an actuator operable to reciprocate a rod string in the well, the actuator including a piston disposed in a cylinder, and a piston rod connected to the piston; and a rod rotator that is configured to continuously rotate the piston rod only during displacement of the piston in a first longitudinal direction, in which the rod rotator comprises a mandrel having a helical first profile, in which the mandrel is engaged with a second profile that is arranged to reciprocate with the piston and piston rod, in which the second profile rotates in a first rotational direction in response to displacement of the piston in the first longitudinal direction, and in which the second profile rotates in a second rotational direction opposite to the first rotational direction in response to displacement of the piston in a second longitudinal direction opposite to the first longitudinal direction.

2. The system of claim 1, in which the first longitudinal direction comprises a direction toward the rod string.

3. The system of claim 1, in which the rod rotator is configured to produce no rotation of the piston rod during displacement of the piston in a second longitudinal direction opposite to the first longitudinal direction.

4. The system of claim 1, in which the first profile comprises a helical external spline formed on the mandrel.

5. The system of claim 1, in which the mandrel is disposed within the cylinder.

6. The system of claim 1, in which a one-way clutch of the rod rotator is configured to rotate the piston rod in the first rotational direction, and in which the one-way clutch is configured to prevent rotation of the piston rod in the second rotational direction.

7. The system of claim 1, in which the second profile is disposed within the cylinder.

8. A rod rotator for rotating a rod string in a subterranean well, the rod rotator comprising:

an elongated mandrel having a helical external profile, the mandrel being configured to attach to a cylinder of a hydraulic actuator, the hydraulic actuator being operable to reciprocate the rod string;

an internal profile complementarily shaped relative to the external profile; and a one-way clutch including first and second components, the first component being configured to rotate with the internal profile in response to longitudinal displacement of the internal profile, the second component being configured for attachment to at least one of a piston and a piston rod of the hydraulic actuator, in which the one-way clutch prevents the first component from rotating the second component in a first rotational direction and in which the one-way clutch permits the first component to rotate the second component in a second rotational direction opposite to the first rotational direction, in which the internal profile is configured to rotate in the first rotational direction in response to displacement of the internal profile in a first longitudinal direction, and in which the internal profile is configured to rotate in the second rotational direction in response to displacement of the internal profile in a second longitudinal direction opposite to the first longitudinal direction.

9. The rod rotator of claim 8, in which the one-way clutch is configured to rotate the rod string in the second rotational direction in response to displacement of the internal profile in the second longitudinal direction.

10. The rod rotator of claim 8, further comprising a cylinder connector configured to suspend the mandrel within the cylinder.

11. The rod rotator of claim 8, in which the helical external profile comprises a helical spline formed on the mandrel.

* * * * *